US011139610B2

(12) United States Patent
Tai

(10) Patent No.: US 11,139,610 B2
(45) Date of Patent: Oct. 5, 2021

(54) ELECTRICAL CONNECTOR MODULE

(71) Applicant: Lintes Technology Co., Ltd, New Taipei (TW)

(72) Inventor: Pi Ho Tai, New Taipei (TW)

(73) Assignee: LINTES TECHNOLOGY CO., LTD, New Taipei (TW)

( * ) Notice: Subject to any disclaimer, the term of this patent is extended or adjusted under 35 U.S.C. 154(b) by 0 days.

(21) Appl. No.: 16/850,120

(22) Filed: Apr. 16, 2020

(65) Prior Publication Data

US 2020/0350724 A1 Nov. 5, 2020

(30) Foreign Application Priority Data

May 1, 2019 (CN) ..... 201920639816.7

(51) Int. Cl.
*H01R 13/60* (2006.01)
*H01R 13/518* (2006.01)
*H01R 25/00* (2006.01)

(52) U.S. Cl.
CPC ..... *H01R 13/518* (2013.01); *H01R 25/003* (2013.01)

(58) Field of Classification Search
CPC ..... H01R 13/518; H01R 25/003
USPC ..... 439/38
See application file for complete search history.

(56) References Cited

U.S. PATENT DOCUMENTS 5,807,139 A * 9/1998 Volansky ..... H01R 13/518 439/491
8,579,519 B2 * 11/2013 Wu ..... H01R 13/502 385/75
8,632,351 B2 * 1/2014 Wu ..... H01R 13/6315 439/248
9,093,798 B2 * 7/2015 Locker ..... H01R 12/724
9,490,570 B1 * 11/2016 Hashiguchi ..... H01R 13/28
9,660,396 B2 * 5/2017 Chen ..... H01R 13/7175
9,997,879 B2 * 6/2018 Zhang ..... H01R 24/22
10,263,358 B2 * 4/2019 Wu ..... H01R 13/514
10,483,700 B2 * 11/2019 Chen ..... H01R 27/02
10,775,567 B2 * 9/2020 Yang ..... H01R 13/5213
10,826,227 B2 * 11/2020 Yang ..... G02B 6/3849
(Continued)

FOREIGN PATENT DOCUMENTS

CN 202940419 U 5/2013
CN 109411943 A 3/2019

*Primary Examiner* — Abdullah A Riyami
*Assistant Examiner* — Vladimir Imas
(74) *Attorney, Agent, or Firm* — Locke Lord LLP; Tim Tingkang Xia, Esq.

(57) ABSTRACT

An electrical connector module is used to mate with a mating connector module. The mating connector module has a first mating connector and a second mating connector. A first electrical connector is inserted with the first mating connector. One side of the first electrical connector is provided with a protruding block. A second electrical connector is inserted with the second mating connector. One side of the second electrical connector close to the first electrical connector is provided with a groove corresponding to the protruding block. The protruding block is accommodated in the groove. A length of the groove along an insertion direction is greater than a length of the protruding block along the insertion direction. The protruding block slides in the groove along the insertion direction.

20 Claims, 8 Drawing Sheets

(56) References Cited

U.S. PATENT DOCUMENTS

| | | | | |
|---|---|---|---|---|
| 2016/0020553 | A1* | 1/2016 | Little | H01R 13/631<br>439/38 |
| 2017/0214200 | A1* | 7/2017 | Zhang | H01R 13/6598 |
| 2018/0175540 | A1* | 6/2018 | Wu | H01R 13/514 |
| 2019/0058279 | A1* | 2/2019 | Wu | H01R 27/02 |

* cited by examiner

ELECTRICAL CONNECTOR MODULE

CROSS-REFERENCE TO RELATED PATENT APPLICATION

This non-provisional application claims priority to and the benefit of, pursuant to 35 U.S.C. § 119(a), patent application Serial No. CN201920639816.7 filed in China on May 1, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector module, and more particularly to an electrical connector module capable of being mated with a mating connector module stably.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector module includes a first electrical connector and a second electrical connector. The first electrical connector and the second electrical connector are provided side by side, and the first electrical connector and the second electrical connector are fixed together to jointly mate with a mating connector module, such that the electrical connector module is electrically connected with the mating connector module, thus realizing signal transmission.

However, when the electrical connector module is mated with the mating connector module, since the first electrical connector and the second electrical connector are fixed together, the first electrical connector and the second electrical connector are inconvenient to use. Further, when the electrical connector module is pulled by an external force, since the first electrical connector and the second electrical connector are fixed together, any one of the first electrical connector and the second electrical connector being pulled by the external force would result in the whole electrical connector module being pulled by the external force to fall off directly from the mating connector module, such that the electrical connector module and the mating connector module cannot mate with each other stably, thus affecting the signal transmission between the electrical connector module and the mating connector module.

Therefore, a heretofore unaddressed need to design an electrical connector module exists in the art to address the aforementioned deficiencies and inadequacies.

SUMMARY

The present invention is directed to an electrical connector module capable of assembling a first electrical connector with a second electrical connector through a protruding block and a groove. Since the protruding block may slide in the groove, the first electrical connector and the second electrical connector may be mated with a mating connector module stably.

In order to achieve the foregoing objective, the present invention adopts the following technical solutions:

An electrical connector module is configured to mate with a mating connector module. The mating connector module has a first mating connector and a second mating connector. The electrical connector module includes: a first electrical connector inserted with the first mating connector, wherein one side of the first electrical connector is provided with a protruding block; and a second electrical connector inserted with the second mating connector, wherein one side of the second electrical connector close to the first electrical connector is provided with a groove corresponding to the protruding block, the protruding block is accommodated in the groove, a length of the groove along an insertion direction is greater than a length of the protruding block along the insertion direction, and the protruding block slides in the groove along the insertion direction.

In certain embodiments, the first electrical connector and the second electrical connector are independently formed; and the first electrical connector and the second electrical connector are assembled with each other, and are simultaneously inserted with the first mating connector and the second mating connector, or the first electrical connector and the second electrical connector are respectively and separately inserted with the first mating connector and the second mating connector.

In certain embodiments, the one side of the first electrical connector provided with the protruding block is also provided with at least one first magnet, the first magnet is located at one side of the protruding block along the insertion direction, the one side of the second electrical connector close to the first electrical connector is provided with at least one second magnet corresponding to the first magnet, the second magnet is located at one side of the groove along the insertion direction, and the first magnet and the second magnet attract each other.

In certain embodiments, two first magnets are provided respectively at two sides of the protruding block, the first magnets are embedded in the first electrical connector, the protruding block is formed by protruding from the first electrical connector toward the second electrical connector, two second magnets are provided respectively at two opposite sides of the groove, the second magnets are embedded in the second electrical connector, and the groove is formed by being recessed from the second electrical connector toward a side away from the first electrical connector.

In certain embodiments, when the first electrical connector and the second electrical connector are assembled with each other, at least one gap exists between the protruding block and the groove along the insertion direction.

In certain embodiments, two gaps exist between the protruding block and the groove along the insertion direction, the electrical connector module is applied with a force to move for a first distance toward an end away from the mating connector module along the insertion direction, and the first distance is less than a sum of lengths of the two gaps along the insertion direction.

In certain embodiments, when the electrical connector module is pulled by an external force, the first electrical connector moves for a second distance relative to the second electrical connector along the insertion direction, and the second distance is greater than the first distance.

In certain embodiments, the first electrical connector has a first shell, a front end surface of the first shell is provided with a first mating portion mated with the first mating connector, the second electrical connector has a second shell, a front end surface of the second shell is provided with a second mating portion mated with the second mating connector, the front end surface of the second shell is flush with the front end surface of the first shell, and the second mating portion extends forward beyond the first mating portion.

In certain embodiments, a rear end surface of the first shell is provided with a first wiring hole, a first cable extends into the first shell through the first wiring hole to be electrically connected with the first mating portion, a rear end surface of the second shell is provided with a second wiring hole, and a second cable extends into the second shell through the second wiring hole to be electrically connected with the second mating portion.

In certain embodiments, a height of the protruding block perpendicular to the insertion direction is equal to a height of the groove perpendicular to the insertion direction.

Compared with the related art, the electrical connector module according to certain embodiments of the present invention have the following beneficial effects.

The protruding block is accommodated in the groove. The length of the groove along the insertion direction is greater than the length of the protruding block along the insertion direction, and the protruding block slides in the groove along the insertion direction. Thus, when the electrical connector module is mated with the mating connector module, the first electrical connector and the second electrical connector are assembled through the match between the protruding block and the groove, and the protruding block may slide in the groove along the insertion direction. Compared with the solution in the related art, when any one of the first electrical connector and the second electrical connector is pulled by the external force, the second electrical connector will move for a distance relative to the first electrical connector along the insertion direction, and when the groove does not stop the protruding block from moving, the first electrical connector does not move. That is, if only the second electrical connector is pulled by the external force, the first electrical connector will not be entangled and move together. Only when the groove stops the protruding block from moving, the first electrical connector and the second electrical connector may move together toward one end away from the mating connector module along the insertion direction. Thus, the distance of the electrical connector module moving toward the end away from the mating connector module along the insertion direction is overall shortened. Accordingly, the mating connector module provides a certain movement buffer, thereby preventing the stable mating of one of the first electrical connector and the second electrical connector from being affected when the other of the first electrical connector and the second electrical connector is pulled by the external force, and preventing the whole electrical connector module from falling off once it is pulled by the external force, such that the electrical connector module and the mating connector module can mate with each other stably, thereby facilitating the signal transmission between the electrical connector module and the mating connector module.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Unless otherwise stated, the same reference numbers are used throughout the drawings to refer to the same or like elements of an embodiment, and wherein.

DETAILED DESCRIPTION

Figure 1:
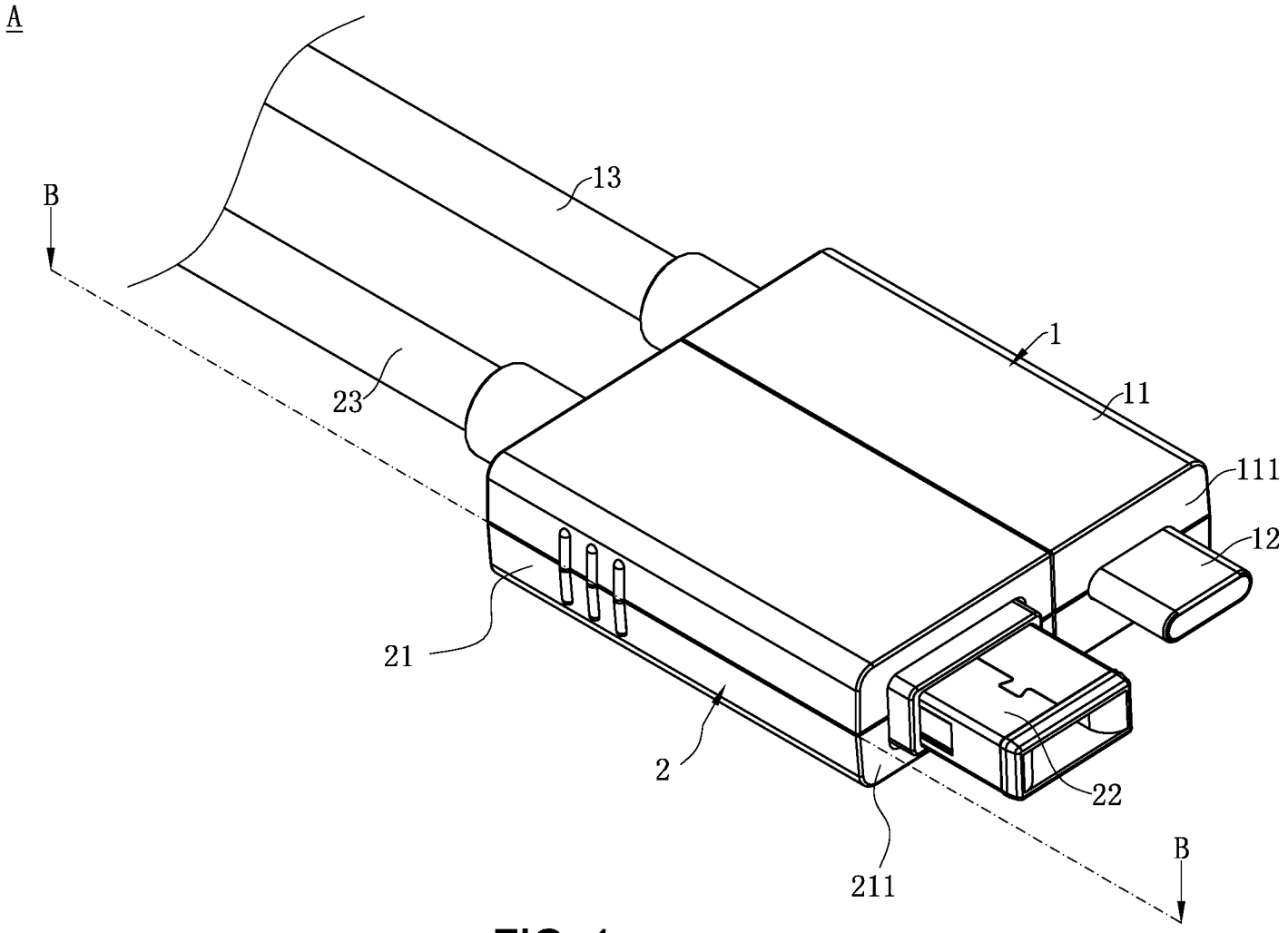
FIG. 1 is a perspective assembled view of an electrical connector module according to certain embodiments of the present invention.
Figure 2:
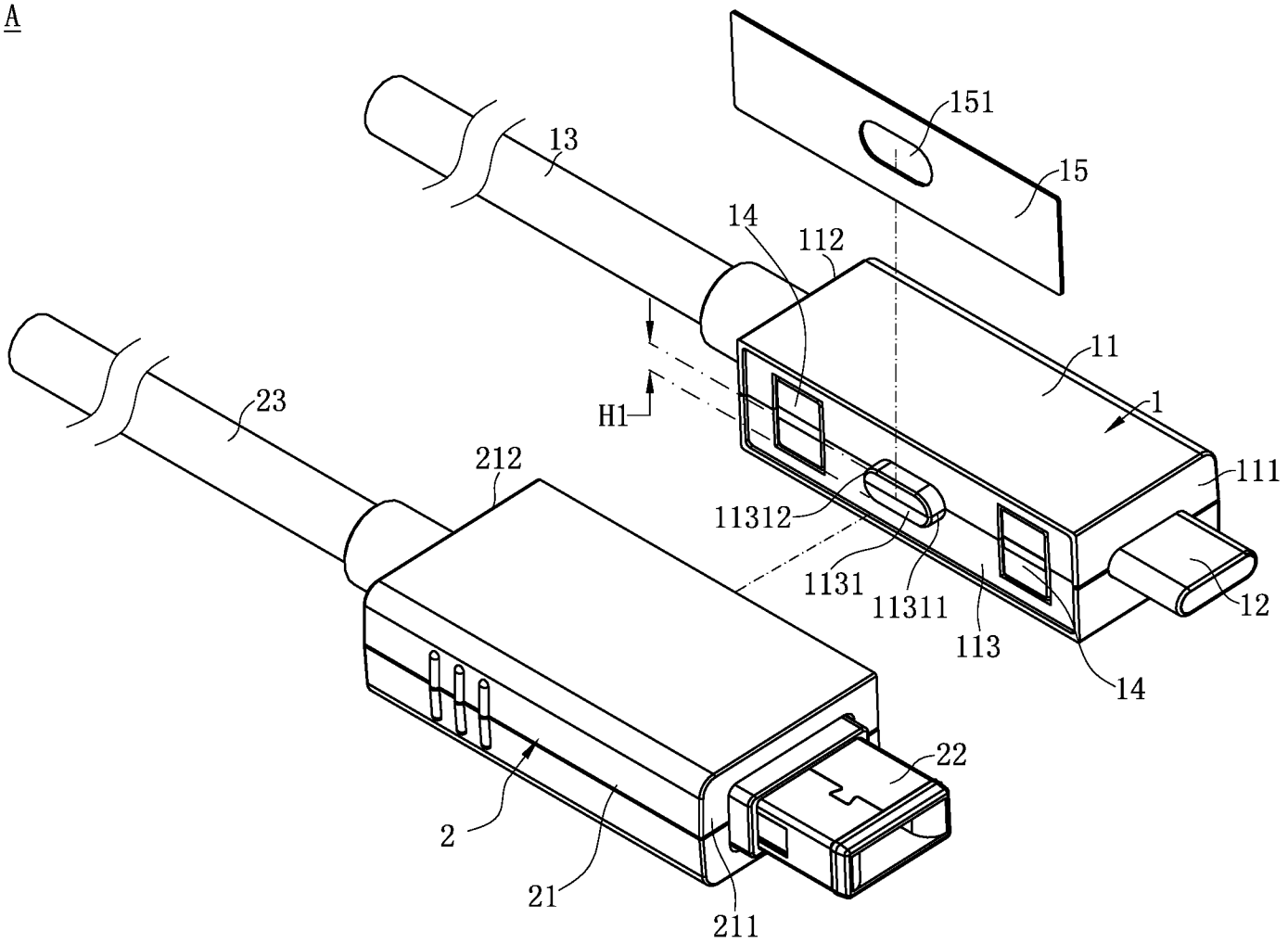
FIG. 2 is a perspective assembled view of a first electrical connector and a second electrical connector being disassembled from one viewing angle of according to certain embodiments the present invention.
Figure 3:
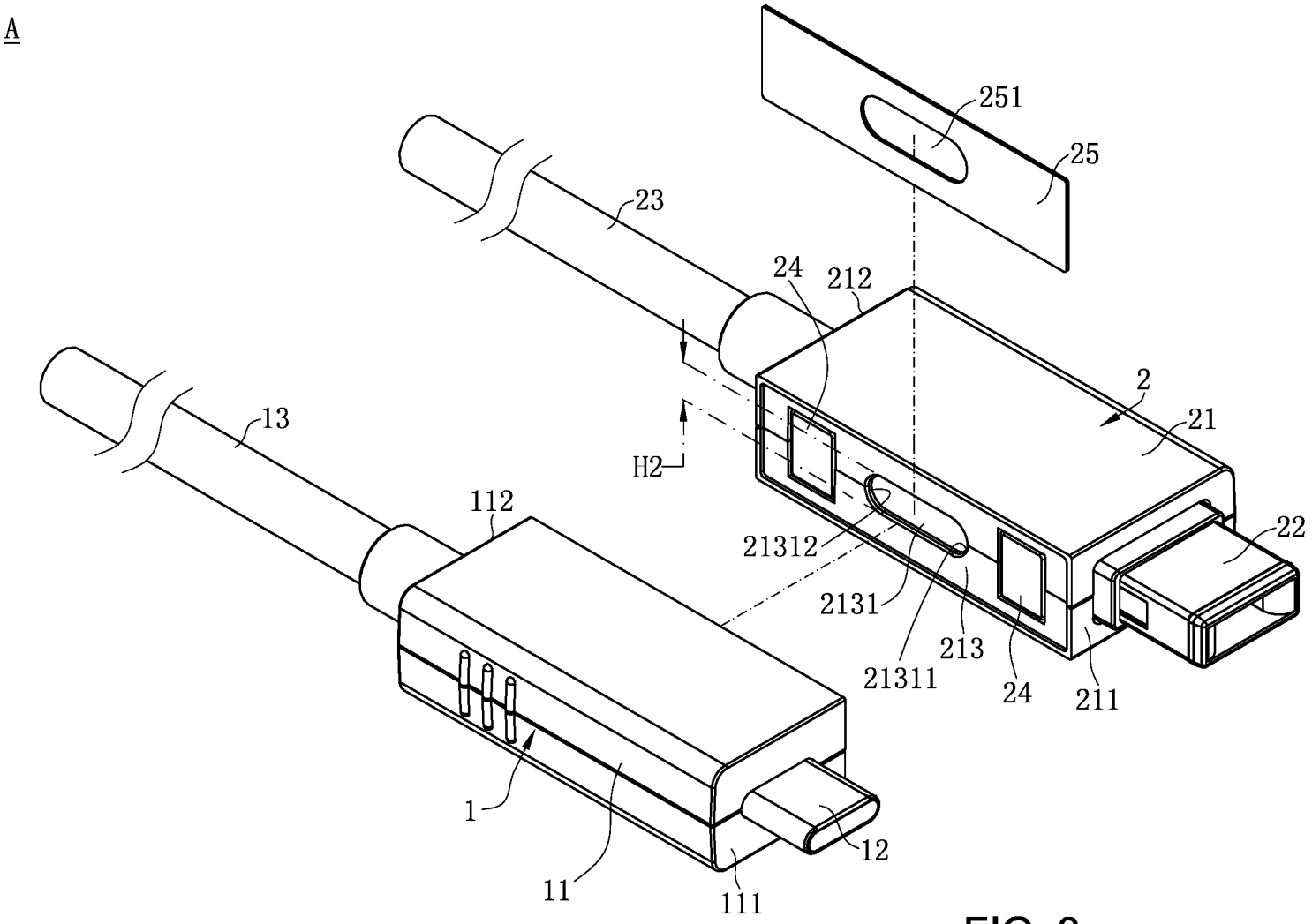
FIG. 3 is a perspective assembled view of a first electrical connector and a second electrical connector being disassembled from another viewing angle according to certain embodiments of the present invention.
Figure 4:
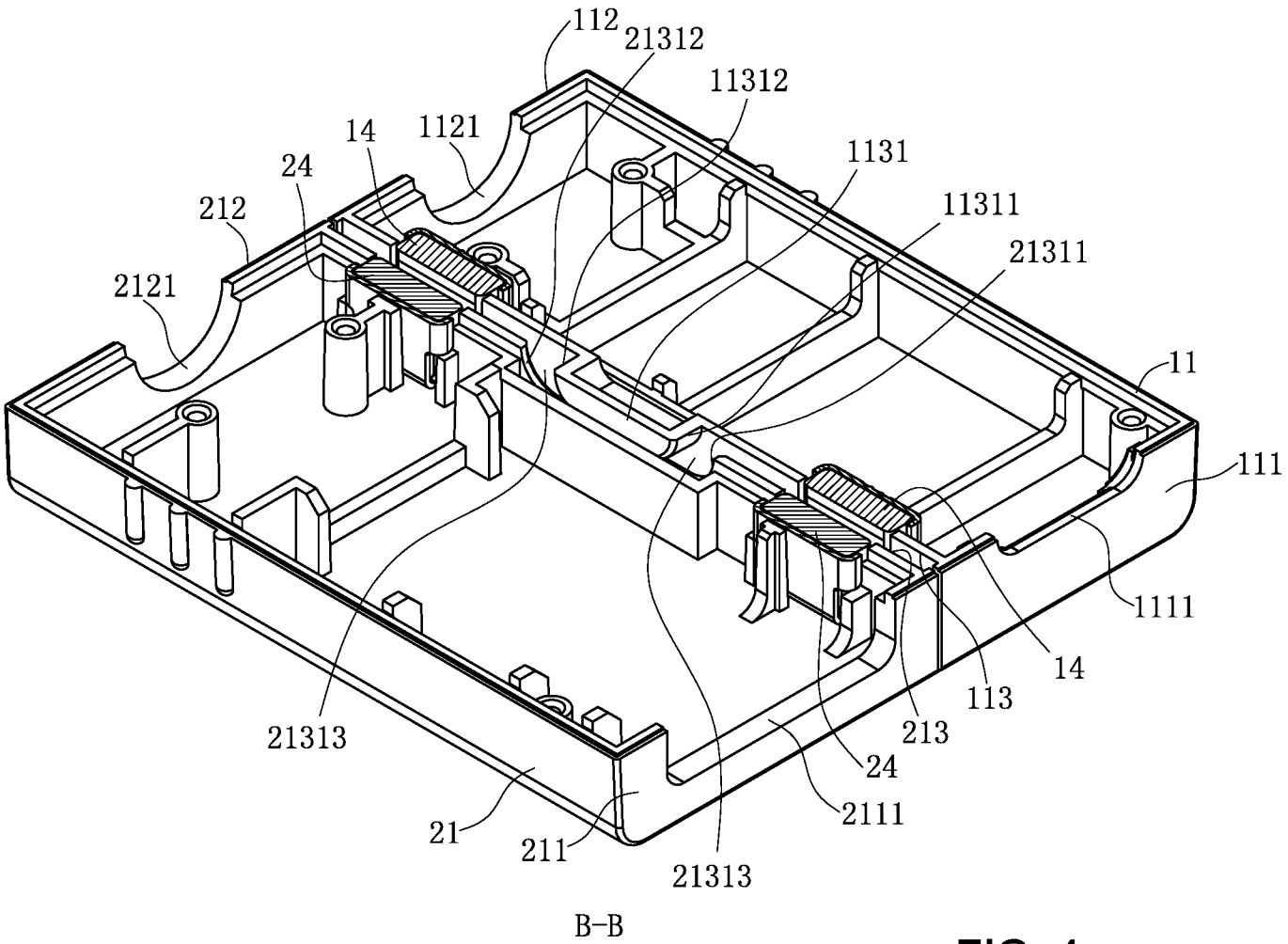
FIG. 4 is a sectional view of a first shell and a second shell in FIG. 1 along a B-B direction.
Figure 5:
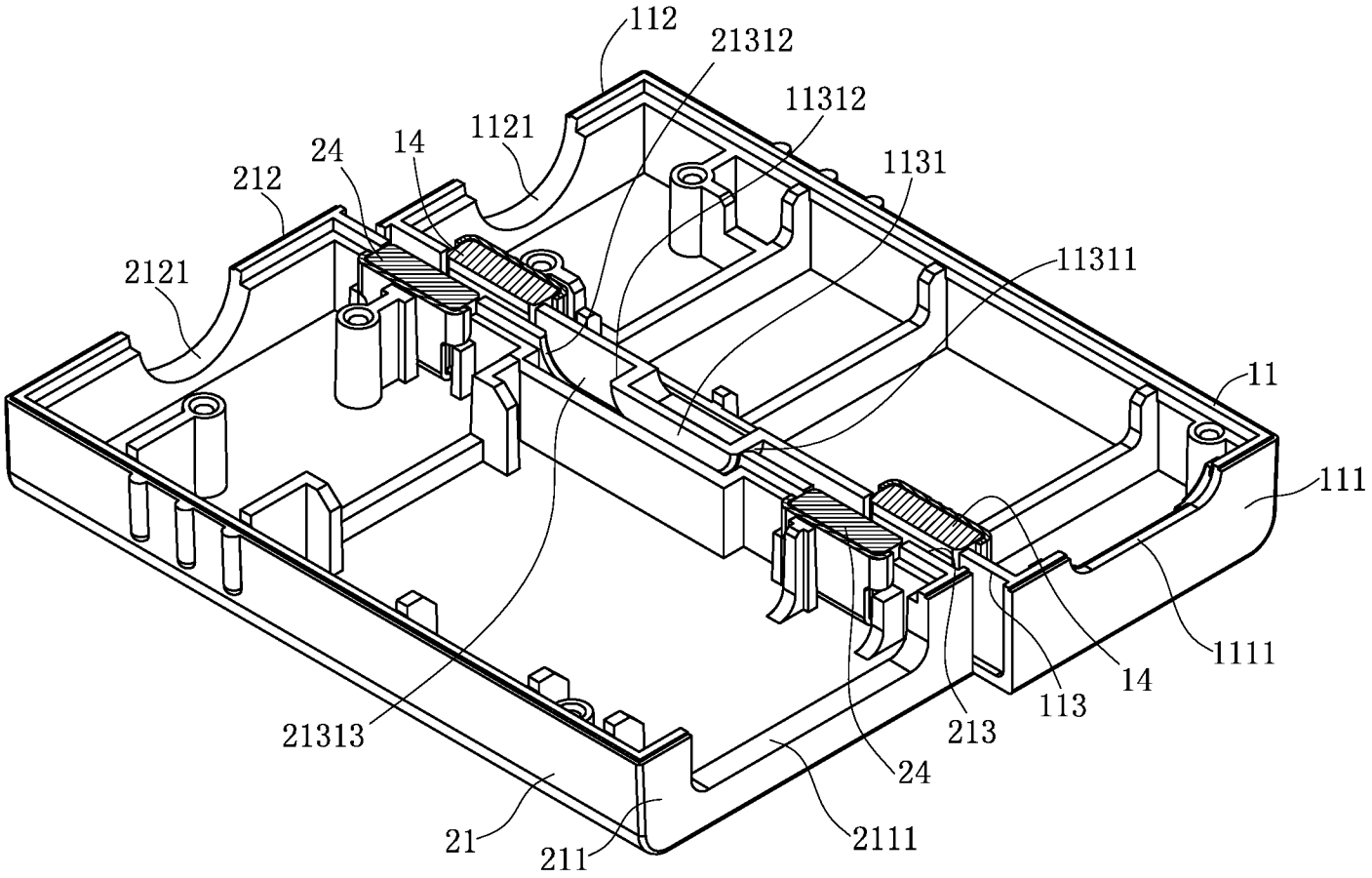
FIG. 5 is a sectional view of forward movement of the first shell relative to the second shell in FIG. 1 along the B-B direction.
Figure 6:
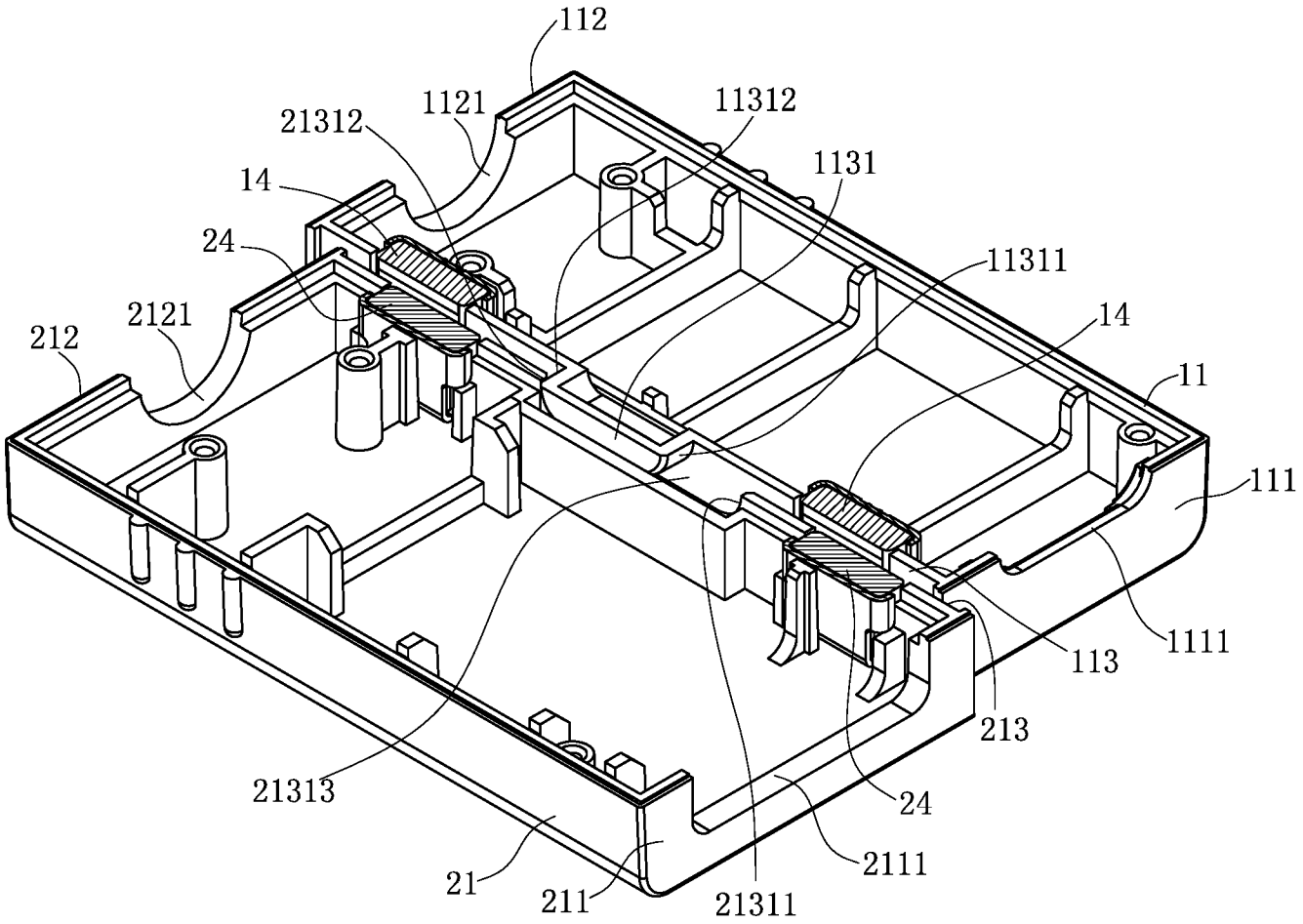
FIG. 6 is a sectional view of backward movement of the first shell relative to the second shell in FIG. 1 along the B-B direction.
Figure 7:
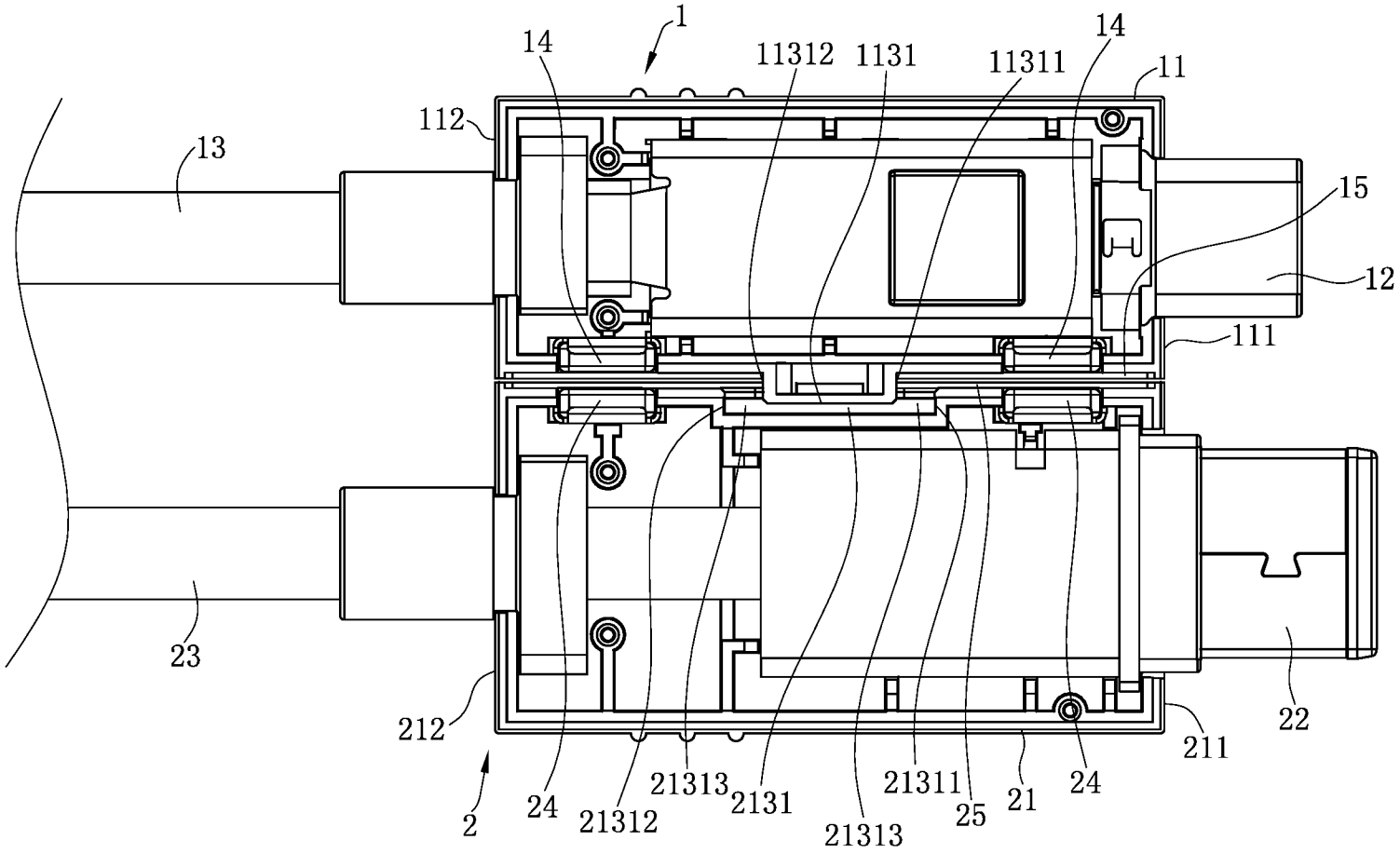
FIG. 7 is a top view of an electrical connector module according to certain embodiments of the present invention.
Figure 8:
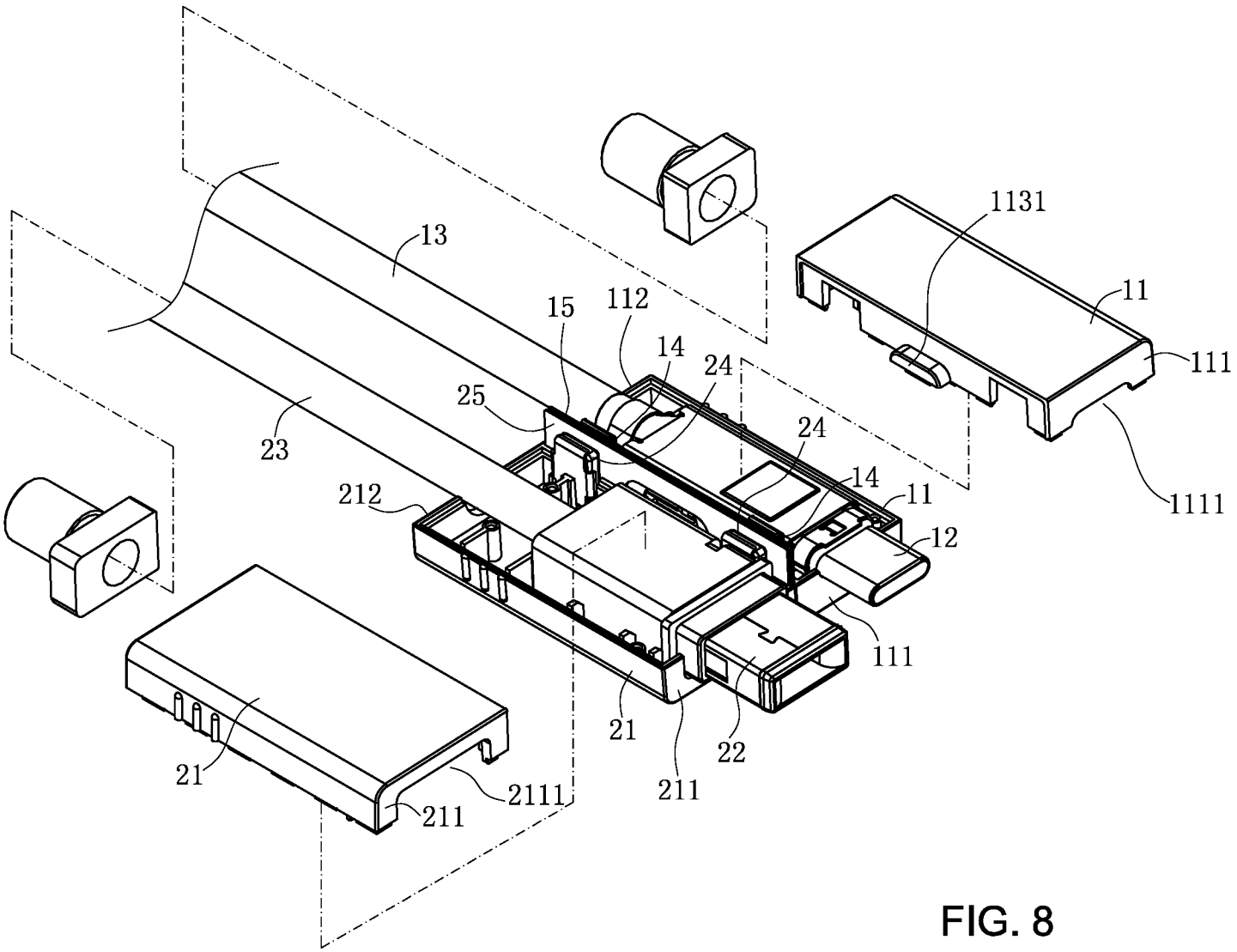
FIG. 8 is a partially exploded perspective view of the electrical connector module in FIG. 1.

The present invention is more particularly described in the following examples that are intended as illustrative only since numerous modifications and variations therein will be apparent to those skilled in the art. Various embodiments of the invention are now described in detail. Referring to the drawings, unless otherwise stated, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector module.

FIG. 1 to FIG. 8 show an embodiment of the present invention.

As shown in FIG. 1, an electrical connector module A according to certain embodiments of the present invention is mated with a mating connector module (not shown, same below). The electrical connector module A includes a first electrical connector 1 and a second electrical connector 2 provided side by side with the first electrical connector 1. The mating connector module includes a first mating connector (not shown, same below) and a second mating connector (not shown, same below). The first mating connector is used to mate with the first electrical connector 1, and the second mating connector is used to mate with the second electrical connector 2.

As shown in FIG. 1, FIG. 2, FIG. 4 and FIG. 7, the first electrical connector 1 has a first shell 11 and a first mating portion 12. The first shell 11 is provided with a first front end surface 111, a first rear end surface 112 and a first side surface 113 connecting the first front end surface 111 with the first rear end surface 112. The first front end surface 111 is provided with a first mating hole 1111. The first mating portion 12 is provided in the first shell 11, and the first mating portion 12 passes through the first mating hole 1111 to be exposed from the first front end surface 111 to mate with the first mating connector. The first rear end surface 112 is provided with a first wiring hole 1121. The first wiring hole 1121 is used to insert a first cable 13, such that the first cable 13 enters the first shell 11 to be electrically connected with the first mating portion 12. The first side surface 113 is located on one side of the first electrical connector 1 close to the second electrical connector 2. One end of the first side surface 113 is connected with the first front end surface 111, and the other end of the first side surface 113 is connected with the first rear end surface 112. A protruding block 1131 also protrudes from the first side surface 113. The protruding block 1131 is located at a middle position of the first side surface 113, and is formed by protruding from the first side surface 113 toward the side close to the second electrical connector 2. The protruding block 1131 is provided with a first end surface 11311 and a second end surface 11312 opposite to each other, and two side surfaces connecting the first end surface 11311 with the second end surface 11312. The first end surface 11311 is closer to the first front end surface 111 than the second end surface 11312. A first height H1 is provided between the two side surfaces of the protruding block 1131. The first electrical connector 1 is further provided with two first magnets 14 respectively provided at two sides of the protruding block 1131 along an insertion direction. The outer surfaces of the first magnets 14 are exposed from the first side surface 113 to be connected with the second electrical connector 2. The first electrical connector 1 is further provided with a lengthwise first side plate 15. The first side plate 15 is fixedly provided on the first electrical connector 1, and covers the outer surface of the first side surface 113. The first side plate 15 is provided with a first through hole 151 corresponding to the protruding block 1131. The protruding block 1131 passes through the first through hole 151. The outer surfaces of the first magnets 14 abut the first side plate 15, thus preventing the first magnets 14 from falling off from the first electrical connector 1.

As shown in FIG. 1, FIG. 3, FIG. 4 and FIG. 7, the second electrical connector 2 has a second shell 21 and a second mating portion 22. The second shell 21 is provided with a second front end surface 211, a second rear end surface 212 and a second side surface 213 connecting the second front end surface 211 and the second rear end surface 212. The second front end surface 211 is flush with the first front end surface 111, and the second front end surface 211 is provided with a second mating hole 2111. The second mating portion 22 is provided in the second shell 21, and the second mating portion 22 passes through the second mating hole 2111 to be exposed from the second front end surface 211. A length of the second mating portion 22 exceeds a length of the first mating portion 12 forward along the insertion direction. The second mating portion 22 is used to be inserted with the second mating connector to realize signal transmission between the second electrical connector 2 and the second mating connector. The second rear end surface 212 is flush with the first rear end surface 112, and the second rear end surface 212 is provided with a second wiring hole 2121. The second wiring hole 2121 is used to insert a second cable 23, such that the second cable 23 enters the second shell 21 to be electrically connected with the second mating portion 22, thus realizing the signal transmission.

As shown in FIG. 1, FIG. 3, FIG. 4 and FIG. 7, the second side surface 213 is located at one side of the second electrical connector 2 close to the first electrical connector 1. One end of the second side surface 213 is connected with the second front end surface 211, and the other end of the second side surface 213 is connected with the second rear end surface 212. The second side surface 213 is provided with a groove 2131 corresponding to the protruding block 1131. The groove 2131 is located at a middle position of the second side surface 213, and is formed by being recessed from the second side surface 213 toward a side away from the first electrical connector 1. The groove 2131 is used to accommodate the protruding block 1131. A length of the groove 2131 along the insertion direction is greater than a length of the protruding block 1131 along the insertion direction. The groove 2131 is provided with a first inner wall surface 21311 and a second inner wall surface 21312 opposite to each other, and two side surfaces connecting the first inner wall surface 21311 with the second inner wall surface 21312. The first inner wall surface 21311 is closer to the second front end surface 211 than the second inner wall surface 21312. When the protruding block 1131 is accommodated in the groove 2131, a gap 21313 exists between the first end surface 11311 and the first inner wall surface 21311 along the insertion direction, and another gap 21313 exists between the second end surface 11312 and the second inner wall surface 21312 along the insertion direction. The two gaps 21313 are equal in length along the insertion direction. The two side surfaces of the groove 2131 have a second height H2 along a direction perpendicular to the insertion direction. The second height H2 is equal to the first height H1, such that the protruding block 1131 is prevented from moving vertically in the groove 2131, thereby preventing the first electrical connector 1 and the second electrical connector 2 from being staggered vertically. The second electrical connector 2 is further provided with two second magnets 24 corresponding to the first magnets 14. The two second magnets 24 are fixedly provided in the second shell 21, and are located at two opposite sides of the groove 2131 along the insertion direction to attract the first magnets 14, such that the first electrical connector 1 and the second electrical connector 2 are connected. The second electrical connector 2 is further provided with a lengthwise second side plate 25. The second side plate 25 is fixedly provided on the second electrical connector 2, and covers the outer surface of the second side surface 213. The second side plate 25 is provided with a second through hole 251 corresponding to the groove 2131. The size of the second through hole 251 is equal to the size of the groove 2131. The outer surfaces of the second magnets 24 abut the second side plate 25, thus preventing the second magnets 24 from falling off from the second electrical connector 2.

As shown in FIG. 2, FIG. 3, FIG. 7 and FIG. 8, the first electrical connector 1 and the second electrical connector 2 are independently formed. The first electrical connector 1 and the second electrical connector 2 may be assembled together through the matching of the protruding block 1131 and the groove 2131 and the mutual attraction between the first magnets 14 and the second magnets 24, and are inserted with the first mating connector and the second mating connector simultaneously. Alternatively, the first electrical connector 1 and the second electrical connector 2 are disassembled to be used separately and then inserted with the first mating connector and the second mating connector respectively. When the first electrical connector 1 and the second electrical connector 2 are assembled together and inserted with the first mating connector and the second mating connector simultaneously, and when the first electrical connector 1 and the second electrical connector 2 are not pulled by an external force, the two first magnets 14 and the two second magnets 24 attract each other, the protruding block 1131 is accommodated in the groove 2131, and the two gaps 21313 are equal in length along the insertion direction.

As shown in FIG. 4, FIG. 5, FIG. 6 and FIG. 7, when the first electrical connector 1 and the second electrical connector 2 are simultaneously pulled by an external force, the first electrical connector 1 and the second electrical connector 2 move together for a first distance toward one end away from the first mating connector and the second mating connector along the insertion direction, and the first electrical connector 1 moves for a second distance relative to the second electrical connector 2 along the insertion direction. The second distance is greater than the first distance, and the first distance is less than a sum of the lengths of the two gaps 21313. Since the first electrical connector 1 and the second electrical connector 2 are simultaneously pulled by the external force, the second electrical connector 2 may move a distance relative to the first electrical connector 1 along the insertion direction. When the groove 2131 does not stop the protruding block 1131 from moving, the first electrical connector 1 does not move. When the groove 2131 stops the protruding block 1131 from moving, the first electrical connector 1 and the second electrical connector 2 can move together toward the end away from the mating connector module along the insertion direction. Thus, the distance of the electrical connector module A moving toward the end away from the mating connector module along the insertion direction is overall shortened. Accordingly, the first electrical connector 1 and the second electrical connector 2 are mated with the first mating connector and the second mating connector more stably. When the external force is removed, since the first magnets 14 and the second magnets 24 attract each other, the protruding block 1131 reversely slides to the original position along the insertion direction. Therefore, the first front end surface 111 of the first electrical connector 1 and the second front end surface 211 of the second electrical connector are flush again, and the electrical connector module A may mate with the mating connector module stably.

To sum up, the electrical connector module A according to certain embodiments of the present invention has the following beneficial effects:

(1) The protruding block 1131 is accommodated in the groove 2131. The length of the groove 2131 along the insertion direction is greater than the length of the protruding block 1131 along the insertion direction, and the protruding block 1131 slides in the groove 2131 along the insertion direction. Thus, when the electrical connector module A is mated with the mating connector module, the first electrical connector 1 and the second electrical connector 2 are assembled through the match between the protruding block 1131 and the groove 2131, and the protruding block 1131 may slide in the groove 2131 along the insertion direction. Compared with the solution in the related art, when any one of the first electrical connector 1 and the second electrical connector 2 is pulled by the external force, the second electrical connector 2 will move for a distance relative to the first electrical connector 1 along the insertion direction, and when the groove 2131 does not stop the protruding block 1131 from moving, the first electrical connector 1 does not move. That is, if only the second electrical connector 2 is pulled by the external force, the first electrical connector 1 will not be entangled and move together. Only when the groove 2131 stops the protruding block 1131 from moving, the first electrical connector 1 and the second electrical connector 2 may move together toward one end away from the mating connector module along the insertion direction. Thus, the distance of the electrical connector module A moving toward the end away from the mating connector module along the insertion direction is overall shortened. Accordingly, the mating connector module A provides a certain movement buffer, thereby preventing the stable mating of one of the first electrical connector 1 and the second electrical connector 2 from being affected when the other of the first electrical connector 1 and the second electrical connector 2 is pulled by the external force, and preventing the whole electrical connector module A from falling off once it is pulled by the external force, such that the electrical connector module A and the mating connector module can mate with each other stably, thereby facilitating the signal transmission between the electrical connector module A and the mating connector module.

(2) The two first magnets 14 are respectively provided at the two sides of the protruding block 1131, and the two second magnets 24 correspond to the first magnets 14 and are respectively provided at the two sides of the groove

2131. The first magnets 14 and the second magnets 24 attract each other, such that the first electrical connector 1 and the second electrical connector 2 may be connected more stably, and after the first electrical connector 1 and the second electrical connector 2 are pulled by the external force to be staggered in a front-rear direction, the first magnets 14 and the second magnets 24 attract each other to return the first electrical connector 1 and the second electrical connector 2 back to their positions.

(3) The first electrical connector 1 and the second electrical connector 2 are assembled with each other and simultaneously inserted with the first mating connector and the second mating connector. Alternatively, the first electrical connector 1 and the second electrical connector 2 are separately inserted with the first mating connector and the second mating connector respectively, such that the first electrical connector 1 and the second electrical connector 2 are convenient to use.

(4) The height of the protruding block 1131 perpendicular to the insertion direction is equal to the height of the groove 2131 perpendicular to the insertion direction, such that the protruding block 1131 is limited in the groove 2131, preventing the first electrical connector 1 and the second electrical connector 2 from being staggered vertically when being pulled by the external force, thereby enabling the first electrical connector 1 and the second electrical connector 2 to mate with the first mating connector and the second mating connector well.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector module, configured to mate with a mating connector module, the mating connector module having a first mating connector and a second mating connector, and the electrical connector module comprising:

a first electrical connector inserted with the first mating connector, wherein one side of the first electrical connector is provided with a protruding block, and the protruding block has a first end surface and a second end surface provided opposite to each other along an insertion direction; and a second electrical connector inserted with the second mating connector, wherein one side of the second electrical connector close to the first electrical connector is provided with a groove corresponding to the protruding block, a length of the groove along the insertion direction is greater than a length of the protruding block along the insertion direction, the groove is provided with a first inner wall surface and a second inner wall surface opposite to each other along the insertion direction, wherein when the first electrical connector and the second electrical connector are assembled together and are simultaneously inserted with the first mating connector and the second mating connector, and the first electrical connector and the second electrical connector are not applied with an external force, the protruding block is accommodated in the groove, a first gap exists between the first end surface and the first inner wall surface along the insertion direction, and a second gap exists between the second end surface and the second inner wall surface along the insertion direction; and wherein when the first electrical connector and the second electrical connector are assembled together and are simultaneously inserted with the first mating connector and the second mating connector, and the first electrical connector and the second electrical connector are applied with the external force, the protruding block is capable of sliding in the groove along the insertion direction and a reverse direction of the insertion direction.

2. The electrical connector module according to claim 1, wherein:

the first electrical connector and the second electrical connector are independently formed; and the first electrical connector and the second electrical connector are assembled with each other, and are simultaneously inserted with the first mating connector and the second mating connector, or the first electrical connector and the second electrical connector are respectively and separately inserted with the first mating connector and the second mating connector.

3. The electrical connector module according to claim 1, wherein the one side of the first electrical connector provided with the protruding block is also provided with at least one first magnet, the first magnet is located at one side of the protruding block along the insertion direction, the one side of the second electrical connector close to the first electrical connector is provided with at least one second magnet corresponding to the first magnet, the second magnet is located at one side of the groove along the insertion direction, and the first magnet and the second magnet attract each other.

4. The electrical connector module according to claim 3, wherein two first magnets are provided respectively at two sides of the protruding block, the first magnets are embedded in the first electrical connector, the protruding block is formed by protruding from the first electrical connector toward the second electrical connector, two second magnets are provided respectively at two opposite sides of the groove, the second magnets are embedded in the second electrical connector, and the groove is formed by being recessed from the second electrical connector toward a side away from the first electrical connector.

5. The electrical connector module according to claim 1, wherein the electrical connector module is applied with a force to move for a first distance toward an end away from the mating connector module along the insertion direction, and when the electrical connector module is pulled by an external force, the first electrical connector moves for a second distance relative to the second electrical connector along the insertion direction, and the second distance is greater than the first distance.

6. The electrical connector module according to claim 1, wherein the first electrical connector has a first shell, a front end surface of the first shell is provided with a first mating portion mated with the first mating connector, the second electrical connector has a second shell, a front end surface of the second shell is provided with a second mating portion mated with the second mating connector, the front end surface of the second shell is flush with the front end surface of the first shell, and the second mating portion extends forward beyond the first mating portion.

7. The electrical connector module according to claim 6, wherein a rear end surface of the first shell is provided with a first wiring hole, a first cable extends into the first shell through the first wiring hole to be electrically connected with the first mating portion, a rear end surface of the second shell is provided with a second wiring hole, and a second cable extends into the second shell through the second wiring hole to be electrically connected with the second mating portion.

8. An electrical connector module, configured to mate with a mating connector module, the mating connector module having a first mating connector and a second mating connector, and the electrical connector module comprising:

a first electrical connector inserted with the first mating connector, wherein one side of the first electrical connector is provided with a protruding block; and a second electrical connector inserted with the second mating connector, wherein one side of the second electrical connector close to the first electrical connector is provided with a groove corresponding to the protruding block, a length of the groove along an insertion direction is greater than a length of the protruding block along the insertion direction, and when the first electrical connector and the second electrical connector are assembled to each other, the protruding block is accommodated in the groove, wherein two gaps exist between the protruding block and the groove along the insertion direction, the two gaps are respectively located at two sides of the protruding block along the insertion direction, the electrical connector module is applied with a force to move for a first distance toward an end away from the mating connector module along the insertion direction, the first distance is less than a sum of lengths of the two gaps along the insertion direction, and the protruding block is capable of sliding in the groove along the insertion direction and a reverse direction of the insertion direction.

9. The electrical connector module according to claim 8, wherein the one side of the first electrical connector provided with the protruding block is also provided with at least one first magnet, the first magnet is located at one side of the protruding block along the insertion direction, the one side of the second electrical connector close to the first electrical connector is provided with at least one second magnet corresponding to the first magnet, the second magnet is located at one side of the groove along the insertion direction, and the first magnet and the second magnet attract each other.

10. The electrical connector module according to claim 9, wherein two first magnets are provided respectively at two sides of the protruding block, the first magnets are embedded in the first electrical connector, the protruding block is formed by protruding from the first electrical connector toward the second electrical connector, two second magnets are provided respectively at two opposite sides of the groove, the second magnets are embedded in the second electrical connector, and the groove is formed by being recessed from the second electrical connector toward a side away from the first electrical connector.

11. The electrical connector module according to claim 8, wherein when the electrical connector module is pulled by the external force, the first electrical connector moves for a second distance relative to the second electrical connector along the insertion direction, and the second distance is greater than the first distance.

12. The electrical connector module according to claim 8, wherein the first electrical connector has a first shell, a front end surface of the first shell is provided with a first mating portion mated with the first mating connector, the second electrical connector has a second shell, a front end surface of the second shell is provided with a second mating portion mated with the second mating connector, the front end surface of the second shell is flush with the front end surface of the first shell, and the second mating portion extends forward beyond the first mating portion.

13. The electrical connector module according to claim 12, wherein a rear end surface of the first shell is provided with a first wiring hole, a first cable extends into the first shell through the first wiring hole to be electrically connected with the first mating portion, a rear end surface of the second shell is provided with a second wiring hole, and a second cable extends into the second shell through the second wiring hole to be electrically connected with the second mating portion.

14. An electrical connector module, configured to mate with a mating connector module, the mating connector module having a first mating connector and a second mating connector, and the electrical connector module comprising:

a first electrical connector inserted with the first mating connector, wherein one side of the first electrical connector is provided with a protruding block; and a second electrical connector inserted with the second mating connector, wherein one side of the second electrical connector close to the first electrical connector is provided with a groove corresponding to the protruding block, the protruding block is accommodated in the groove, a length of the groove along an insertion direction is greater than a length of the protruding block along the insertion direction, the protruding block is capable of sliding in the groove along the insertion direction and a reverse direction of the insertion direction, and a height of the protruding block perpendicular to the insertion direction is equal to a height of the groove perpendicular to the insertion direction.

15. The electrical connector module according to claim 14, wherein the one side of the first electrical connector provided with the protruding block is also provided with at least one first magnet, the first magnet is located at one side of the protruding block along the insertion direction, the one side of the second electrical connector close to the first electrical connector is provided with at least one second magnet corresponding to the first magnet, the second magnet is located at one side of the groove along the insertion direction, and the first magnet and the second magnet attract each other.

16. The electrical connector module according to claim 15, wherein two first magnets are provided respectively at two sides of the protruding block, the first magnets are embedded in the first electrical connector, the protruding block is formed by protruding from the first electrical connector toward the second electrical connector, two second magnets are provided respectively at two opposite sides of the groove, the second magnets are embedded in the second electrical connector, and the groove is formed by being recessed from the second electrical connector toward a side away from the first electrical connector.

17. The electrical connector module according to claim 14, wherein when the first electrical connector and the second electrical connector are assembled with each other, at least one gap exists between the protruding block and the groove along the insertion direction.

18. The electrical connector module according to claim 14, wherein the electrical connector module is applied with a force to move for a first distance toward an end away from the mating connector module along the insertion direction, and when the electrical connector module is pulled by an external force, the first electrical connector moves for a second distance relative to the second electrical connector along the insertion direction, and the second distance is greater than the first distance.

19. The electrical connector module according to claim 14, wherein the first electrical connector has a first shell, a front end surface of the first shell is provided with a first mating portion mated with the first mating connector, the second electrical connector has a second shell, a front end surface of the second shell is provided with a second mating portion mated with the second mating connector, the front end surface of the second shell is flush with the front end surface of the first shell, and the second mating portion extends forward beyond the first mating portion.

20. The electrical connector module according to claim 19, wherein a rear end surface of the first shell is provided with a first wiring hole, a first cable extends into the first shell through the first wiring hole to be electrically connected with the first mating portion, a rear end surface of the second shell is provided with a second wiring hole, and a second cable extends into the second shell through the second wiring hole to be electrically connected with the second mating portion.

* * * * *